US010634129B1

(12) United States Patent
Wood

(10) Patent No.: US 10,634,129 B1
(45) Date of Patent: Apr. 28, 2020

(54) DUAL MOTOR COMPRESSOR

(71) Applicant: Wood Industries Inc., Belmont, MS (US)

(72) Inventor: Jeffery O. Wood, Belmont, MS (US)

(73) Assignee: Wood Industries inc., Belmont, MS (US)

( * ) Notice: Subject to any disclaimer, the term of this patent is extended or adjusted under 35 U.S.C. 154(b) by 0 days.

(21) Appl. No.: 16/601,174

(22) Filed: Oct. 14, 2019

(51) Int. Cl.

| | |
|---|---|
| ***F04B 41/02*** | (2006.01) |
| ***F04B 35/06*** | (2006.01) |
| ***F04B 49/22*** | (2006.01) |
| ***F04B 1/16*** | (2006.01) |
| ***F04C 23/00*** | (2006.01) |
| ***F04D 19/00*** | (2006.01) |

(52) U.S. Cl.
CPC ..... *F04B 41/02* (2013.01); *F04B 1/16* (2013.01); *F04C 23/006* (2013.01); *F04D 19/002* (2013.01)

(58) Field of Classification Search
CPC ..... F04D 19/002; F04C 23/006; F04B 1/16; F04B 41/02; F04B 1/06
See application file for complete search history.

(56) References Cited

U.S. PATENT DOCUMENTS 2,256,654 A 9/1941 Spurgeon et al.
4,237,918 A * 12/1980 German ..... F04B 49/022 137/115.18
4,391,568 A 7/1983 Tenney
6,056,521 A 5/2000 Leu et al.
6,068,447 A * 5/2000 Foege ..... F04B 23/02 417/12
7,874,807 B2 1/2011 Hill et al.
8,393,873 B2 3/2013 Hill et al.
2008/0240933 A1* 10/2008 Hill ..... F04B 35/04 417/63

OTHER PUBLICATIONS

California Air Tools 10020C Air Compressor, Published Mar. 3, 2018, Obtained Dec. 23, 2019 (Year: 2018).*
California Air Tools 60040DCADC Air Compressor, Published Mar. 4, 2018, Obtained Dec. 23, 2019 (Year: 2018).*
https://www.youtube.com/watch?v=0goESDHIWEM; California Air Tools 60040CAD Ultra Quiet & Oil-Free 4.0 Hp Air Compressor, Published on Jan. 11, 2018.

* cited by examiner

*Primary Examiner* — Connor J Tremarche
(74) *Attorney, Agent, or Firm* — Waller Lansden Dortch & Davis, LLP; Matthew C. Cox; Blake M. Bernard

(57) ABSTRACT

An air compressor apparatus is disclosed that includes an air tank. A first compressor assembly can be fluidly coupled to the air tank, the first compressor assembly including a first head unloader valve. A second compressor assembly can be fluidly coupled to the air tank, the second compressor assembly including a second head unloader valve. A control unit can be electrically coupled to the first and second compressor assemblies, the control unit operable to control the operation of the first and second compressor assemblies. During startup, the first and second air compressor assemblies can be configured to draw less than 20 amps of current combined from a single 120 volt power source. The first and second compressor assemblies can each be dual piston compressor assemblies.

29 Claims, 8 Drawing Sheets

DUAL MOTOR COMPRESSOR

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to air compressor units for supplying compressed air to a desired system, such as pneumatic tooling including but not limited to nail guns, air wenches, paint sprayers, pressure washers, air inflation devices, air blasting devices, etc.

More particularly, the present disclosure relates to dual air compressor systems having two compressor assemblies for supplying pressurized air to an air tank. When the pressure in an air tank is depleted, the air compressor assemblies can be actuated to drive air into the air tank and increase or maintain the pressure of the air in the air tank. Maintaining the air pressure within the air tank within a desired range can help ensure that air from the air tank which is supplied to the pneumatic tooling is delivered at a desired pressure. Dual motor compressors or compressors with multiple compressor assemblies can be desirable as compressors having dual motors can typically supply air to an air tank of the compressor faster than a single motor unit. This is particularly advantageous in air compressors with larger air tanks or receivers.

During start up, dual motors associated with dual air compressor systems can draw a large current due to the increased force and power needed to start the motors from rest and the reduced resistance in the wiring for the system during a resting state. Conventional dual motor compressor systems if connected to a standard 120V power source will exceed a threshold or desired current limit set for the system, typically 20 amps. Exceeding the desired current limit can potentially cause damage or increase wear to the electrical components of the motors, increase the risk of a fire hazard, or cause the breaker for the circuit to trip, which is undesirable.

As a result, it is often necessary for dual motor air compressors to be electrically connected to two separate 120V power sources on separate breakers, or on a larger voltage source, such as a 240V power outlet, in order to handle the additional power requirements needed from the dual motor compressor during startup. These power requirements can limit the number of locations within a facility at which the dual motor air compressors can be used, as 120V power outlets are more common within most facilities.

Additionally, in rural areas where 3 phase power or 240 V power is not available, such units cannot be used. In residential settings which are equipped primarily with standard 120V outlets, this can require one or more of the 120V outlets in the residence to be upgraded to a 240V outlet, which is costly and inconvenient.

What is needed then are improvements in dual motor air compressor systems.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure is an air compressor apparatus that includes an air tank. A first compressor assembly can be fluidly coupled to the air tank, the first compressor assembly including a first head unloader valve. A second compressor assembly can be fluidly coupled to the air tank, the second compressor assembly including a second head unloader valve. A control unit can be electrically coupled to the first and second compressor assemblies, the control unit operable to control the operation of the first and second compressor assemblies. During startup, the first and second air compressor assemblies can be configured to draw less than 20 amps of current combined from a single 120 volt power source.

Another aspect of the present disclosure is an air compressor apparatus including an air tank. A first dual piston compressor assembly can be fluidly coupled with the air tank, the first dual piston compressor assembly including a first head unloader valve. A second dual piston compressor assembly can be fluidly coupled with the air tank, the second dual piston compressor assembly including a second head unloader valve. A control unit can be electrically coupled to the first and second dual piston compressor assemblies, the control unit including a switch moveable from an open position to a closed position to simultaneously provide power to the first and second dual piston compressor assemblies. Each dual piston compressor assembly can include a first and second head outlet, a pneumatic line fluidly coupled to the first head outlet and the air tank, and an auxiliary pneumatic line fluidly coupled to the second head outlet and air tank.

Another aspect of the present disclosure is an air compressor apparatus including an air tank having a tank inlet. The apparatus can include a dual head check valve having a first inlet, a second inlet, a check valve outlet, and an unloader port. The check valve outlet can be fluidly coupled to the tank inlet. A first dual piston compressor assembly can be fluidly coupled to the first inlet of the dual head check valve, the first dual piston compressor assembly including a first head unloader valve. A second dual piston compressor assembly can be fluidly coupled to the second inlet of the dual head check valve, the second dual piston compressor assembly including a second head unloader valve. An exhaust unloader valve can be fluidly coupled to the unloader port of the check valve. A control unit can be electrically coupled to the first and second dual piston compressor assemblies to control operation of the first and second dual piston compressor assemblies, the control unit configured to control actuation of the unloader valve to selectively release air from the first and second dual piston compressor assemblies through the exhaust unloader valve.

The various unloader valves, compressor assembly configurations, and pneumatic line orientations disclosed herein can help keep the current draw of the apparatus upon startup at a level less than 20 amps when the apparatus is connected to a single 120V power source, which can help avoid blowing fuses in the breaker circuit of the 120V power source during startup and help provide for safe operation of the air compressor apparatus on a 120V power source.

One objective of the present disclosure is to provide an efficient air compressor apparatus which can supply pressurized air to pneumatic tooling.

Another objective of the present disclosure is to provide a dual motor or dual compressor assembly air compressor apparatus that can be operated from a single 120V power source.

Numerous other objects, advantages and features of the present disclosure will be readily apparent to those of skill in the art upon a review of the following drawings and description of a preferred embodiment.

DETAILED DESCRIPTION

Figure 1:
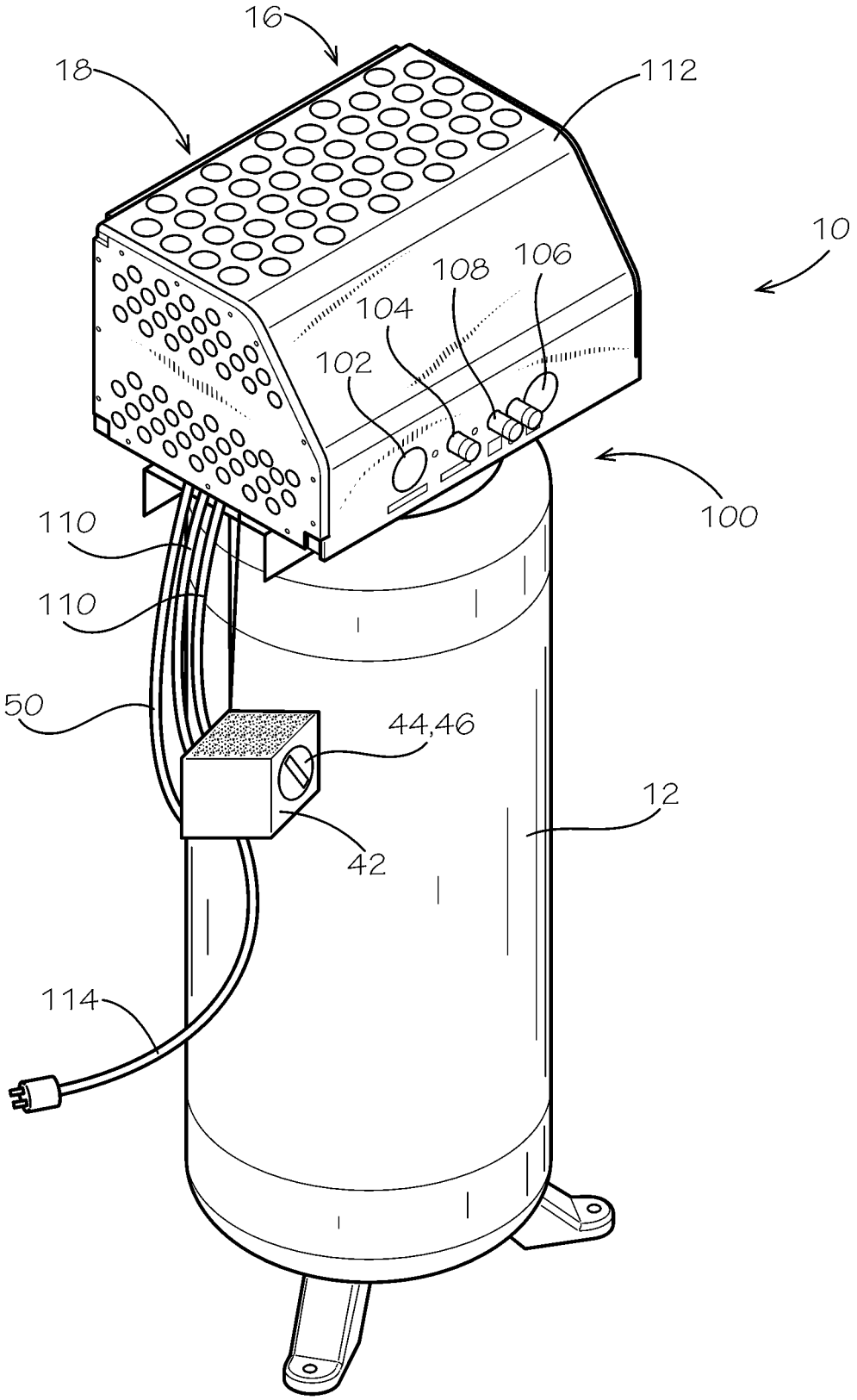
FIG. 1 is a front perspective view of an embodiment of an air compressor apparatus of the present disclosure including two compressor assemblies.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

One aspect of the present disclosure is an air compressor apparatus 10. As shown in FIGS. 1-6, the apparatus 10 can include an air tank 12. The air tank 12 or receiver can be configured to receive and store compressed or pressurized air in the air tank 12. The air tank 12 can include a tank inlet 14. Air can be supplied to the air tank 12 via the tank inlet 14 in order to increase the pressure of the air stored inside the air tank 12. In some embodiments, the air tank 12 can have a storage volume of at least 50 gallons. In some embodiments, the air tank 12 can have a storage volume ranging between 20 and 70 gallons.

Figure 2:
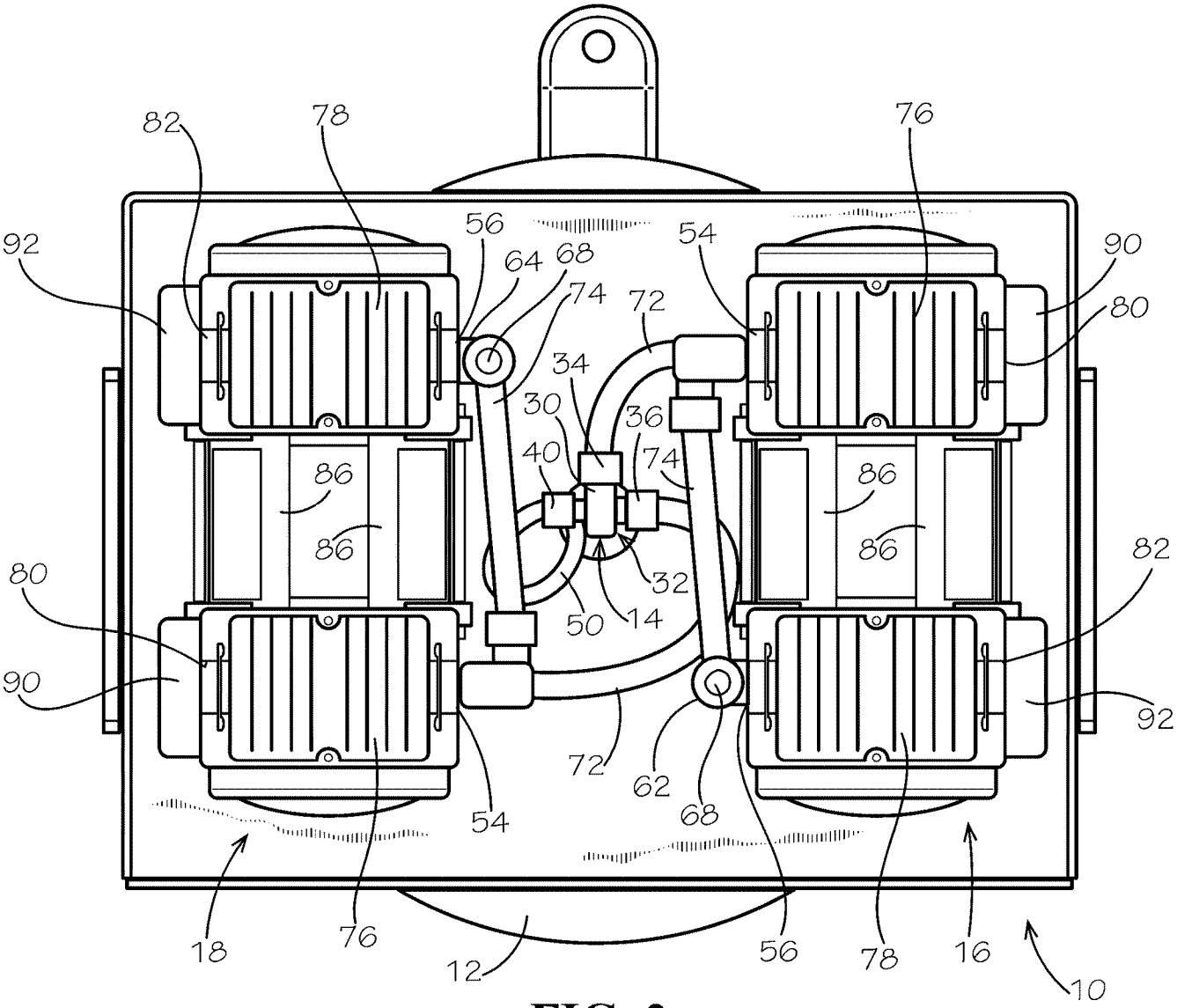
FIG. 2 is a top view of the air compressor apparatus of FIG. 1 with a top cover of a compressor housing removed to show first and second compressor assemblies of the air compressor apparatus.
Figure 3:
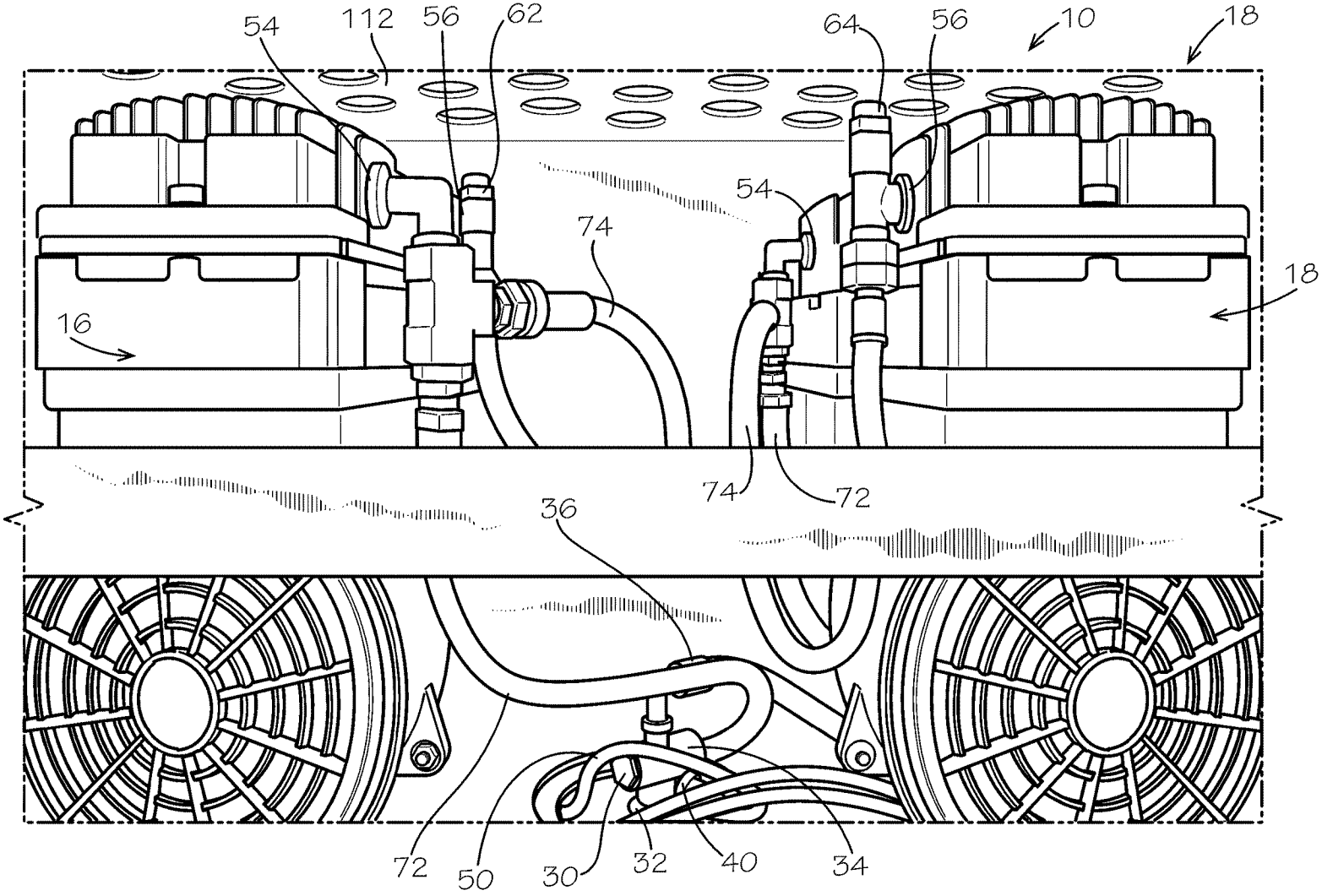
FIG. 3 is a detailed rear view of the air compressor apparatus of FIG. 1 showing various pneumatic line orientations between the compressor assemblies and a check valve connected to an air tank of the air compressor assembly.
Figure 5:
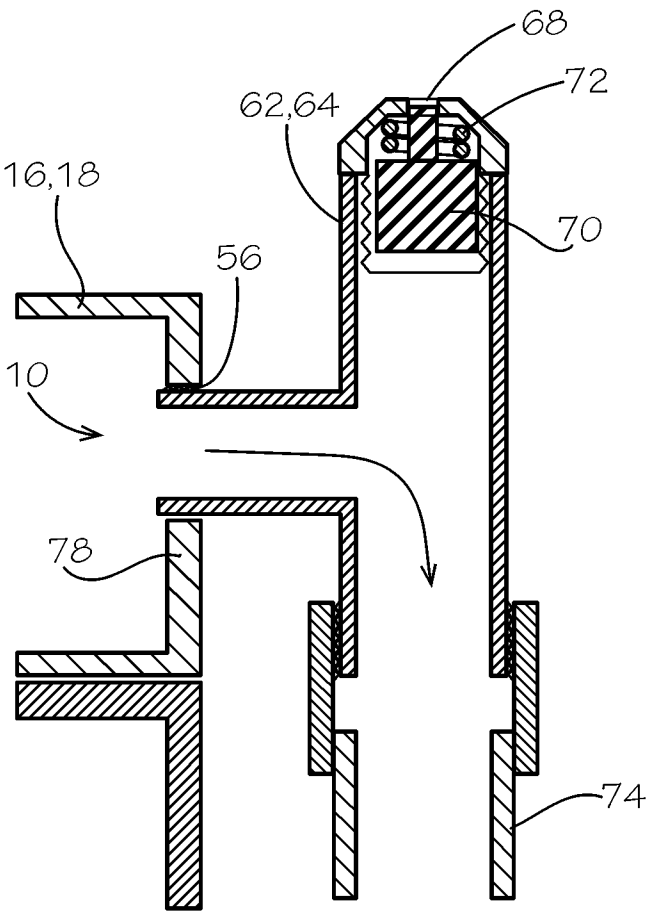
FIG. 5 is a cross sectional view of an embodiment of a head unloader valve of the air compressor apparatus of FIG. 3 showing the head unloader valve in a closed position.
Figure 4:
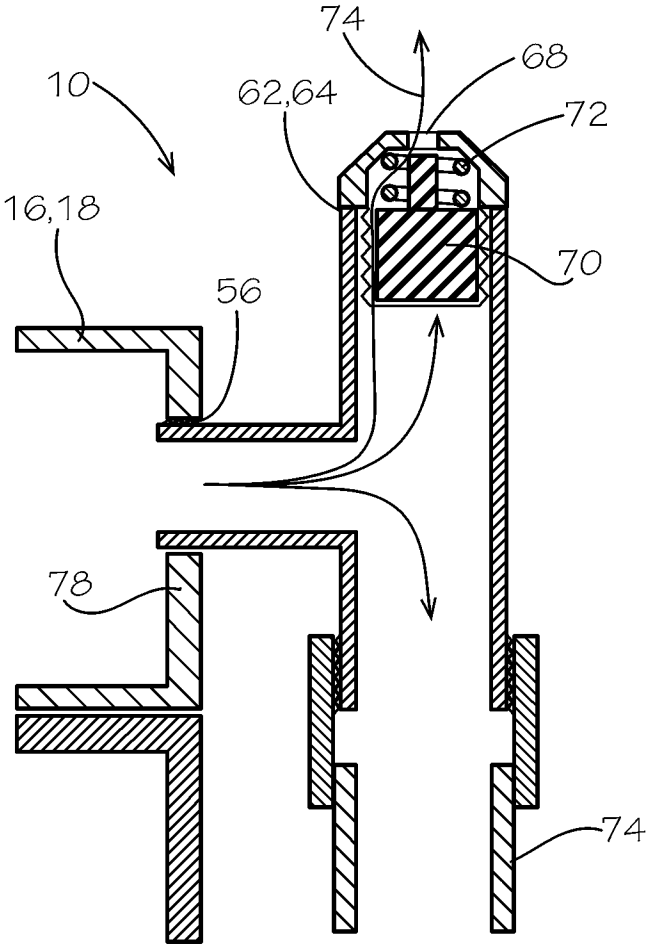
FIG. 4 is a cross sectional view of an embodiment of a head unloader valve of the air compressor apparatus of FIG. 3 showing the head unloader valve in an open position.

As shown in FIGS. 2-3, the apparatus 10 can include a first dual piston compressor assembly 16 which can be fluidly coupled with the air tank 12, and a second dual piston compressor assembly 18 which can be fluidly coupled with the air tank 12. In some embodiments, the first and second dual piston compressor assemblies 16 and 18 can both be fluidly coupled to the air tank inlet 14. In some embodiments, the air tank 12 can include a first air tank inlet and a second air tank inlet. The first dual piston compressor assembly 16 can be fluidly coupled to the first air tank inlet and the second dual piston compressor assembly 18 can be fluidly coupled to the second air tank inlet.

Figure 7:
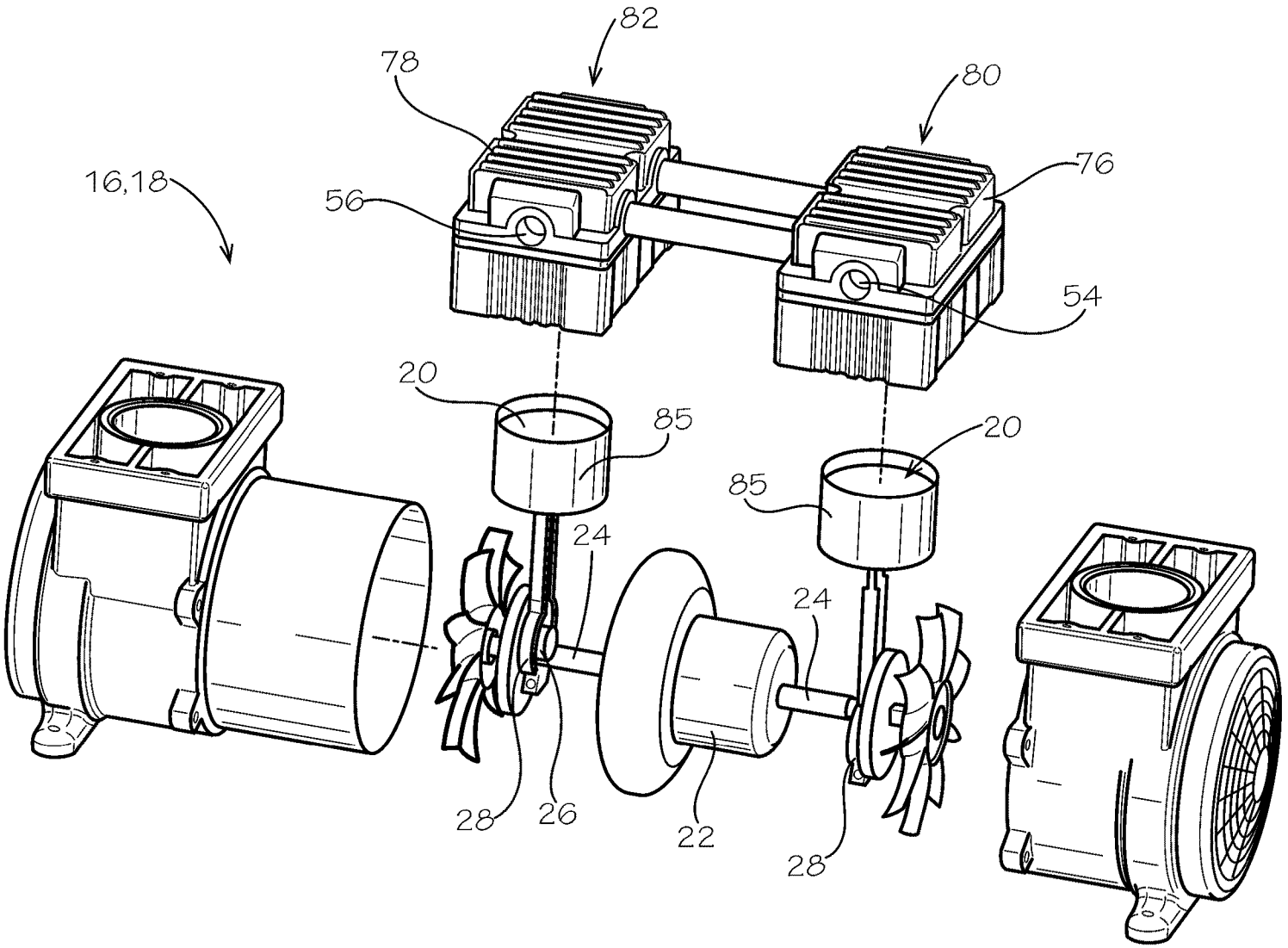
FIG. 7 is an exploded view of one of the compressor assemblies of the air compressor apparatus of FIG. 2.
Figure 8:
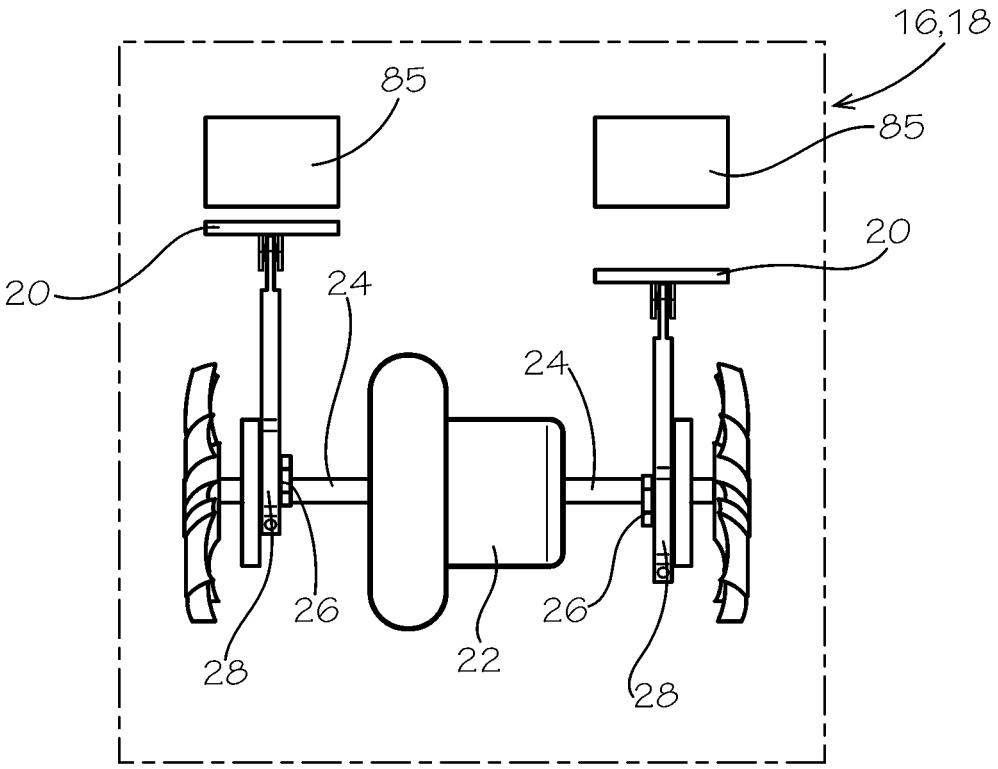
FIG. 8 is a partial side exploded view of the compressor assembly of FIG. 7.
Figure 9:
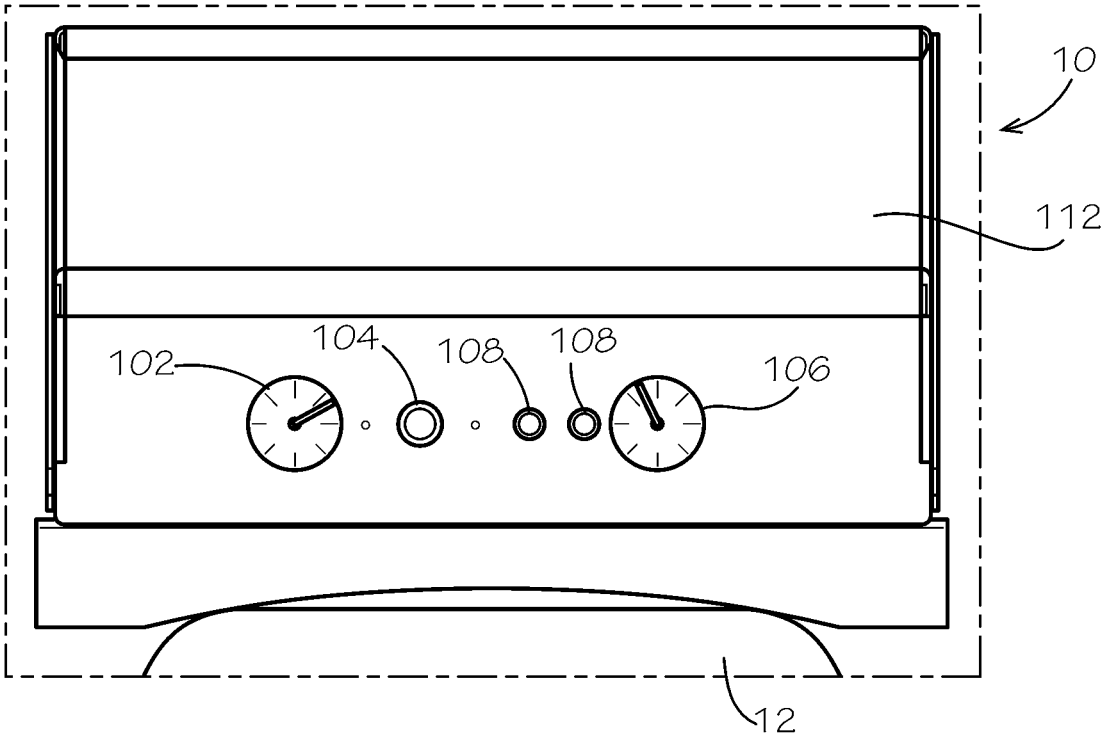
FIG. 9 is a detailed front view of a user interface of the air compressor apparatus of FIG. 1.

The dual piston compressor assemblies 16 and 18 can each include two reciprocating pistons 20 as shown in FIGS. 7-8, which can be driven by a single motor 22. The motors 22 can be any suitable type of motor, including AC brushless or induction motors, or DC brushless motors. A drive shaft 24 connected to each motor 22 can include eccentric cams 26 on the ends of the drive shaft 24 which can be connected to cam followers 28 connected to each piston 20. The eccentric cams 26 can extend radially from the drive shaft 24 in opposing directions such that the pistons 20 can operate in a reciprocating or alternating fashion as the motor 22 rotates the drive shaft 24 to produce alternating piston strokes in each piston 20 for each rotation of the drive shaft 24. Such dual piston compressor assemblies 16 and 18 can provide increased efficiency compared to single piston compressors because the dual compressor assemblies 16 and 18 can provide two piston strokes per rotation of the motor 22 and the drive shaft 24. As such, the motors 22 in the dual piston compressor assemblies 16 and 18 can potentially rotate at a slower speed than the motors of a single piston compressor assembly while generating similar air supply rates to the air tank. The slower motor speed achievable in the dual piston compressor assemblies 16 and 18 can help provide for a quieter operation of the dual piston compressor assemblies 16 and 18 compared to single piston compressor assemblies, and can also help reduce the power and current required to achieve a desired air supply rate.

In some embodiments, the motors 22 of the dual piston compressor assemblies 16 and 18 can rotate at a speed of less than 3000 rpms while collectively supplying air to the air tank 12 at a rate of at least 10 cubic feet per minute at a tank pressure of 40 psi. In other embodiments, the motors 22 of the dual piston compressor assemblies 16 and 18 can rotate at a speed of less than 2000 rpms while collectively supplying air to the air tank 12 at a rate of at least 10 cubic feet per minute at a tank pressure of 40 psi. In still other embodiments, the motors 22 of the dual piston compressor assemblies 16 and 18 can rotate at a speed of less than 1800 rpms while collectively supplying air to the air tank 12 at a rate of at least 10 cubic feet per minute at a tank pressure of 40 psi.

As shown in FIGS. 2-3, the apparatus 10 can include at least one check valve 30 having a check valve outlet 32 fluidly coupled with the air tank inlet 14. The check valve 30 can be configured to allow air to pass through the check valve outlet 32 into the air tank 12, while preventing air within the air tank 12 from flowing out of the air tank 12 through the check valve outlet 32. In some embodiments, the check valve 30 can be a conventional ball-type check valve with a spring biased ball seated in the check valve 30. The ball can be biased in a closed position within the check valve 30 and can be movable to an open position when intake air from the dual piston compressor assemblies 16 and 18 is supplied to the check valve 30 at a pressure higher than the pressure of the air in the air tank 12. When the dual piston compressor assemblies 16 and 18 cease supplying intake air to the check valve 30 and the air pressure on the intake side of the check valve 30 equalizes with the air pressure in the air tank 12 or is less than the air pressure in the air tank 12, the spring within the check valve 16 and the pressure within the air tank 12 can return the ball and the check valve 30 to a closed position to prevent air from leaving the air tank 12 via the check valve 30. While one embodiment of an exemplary check valve 30 has been described herein, any suitable check valve 30 can be used to provide a one way flow of air from the compressor assemblies 16 and 18 into the air tank 12.

In some embodiments, as shown in FIGS. 2-3, the check valve 30 can include a first inlet 34 and a second inlet 36. Air can be supplied to the first inlet 34 or the second inlet 36 and driven through the check valve outlet 32 and into the air tank 12. The first dual piston compressor assembly 16 can be fluidly coupled to the first inlet 34 of the check valve 30 and the second dual piston compressor assembly 18 can be fluidly coupled to the second inlet 36 of the check valve 30. Having the first and second dual piston compressor assemblies 16 and 18 fluidly coupled to the same tank inlet 14 and check valve 30 can allow the fluid pathways of the first and second dual piston compressor assemblies 16 and 18 to be fluidly coupled together such that air pressure within both the first and second dual piston compressor assemblies 16 and 18 can be equalized across both systems. Such an equalization between the two compressor assemblies 16 and 18 can help stabilize the pressure and thus the power required during startup between the two compressor assemblies 16 and 18, which can help balance and control the peak current draw between the two air compressor assemblies 16 and 18 during startup.

In other embodiments where the first dual piston compressor assembly 16 is fluidly coupled to a first tank inlet and the second dual piston compressor assembly 18 is fluidly coupled to a second tank inlet, a first check valve can be coupled between the first tank inlet and the first dual piston compressor assembly 16, and a second check valve can be fluidly coupled between the second tank inlet and the second dual piston compressor assembly 18.

Figure 6:
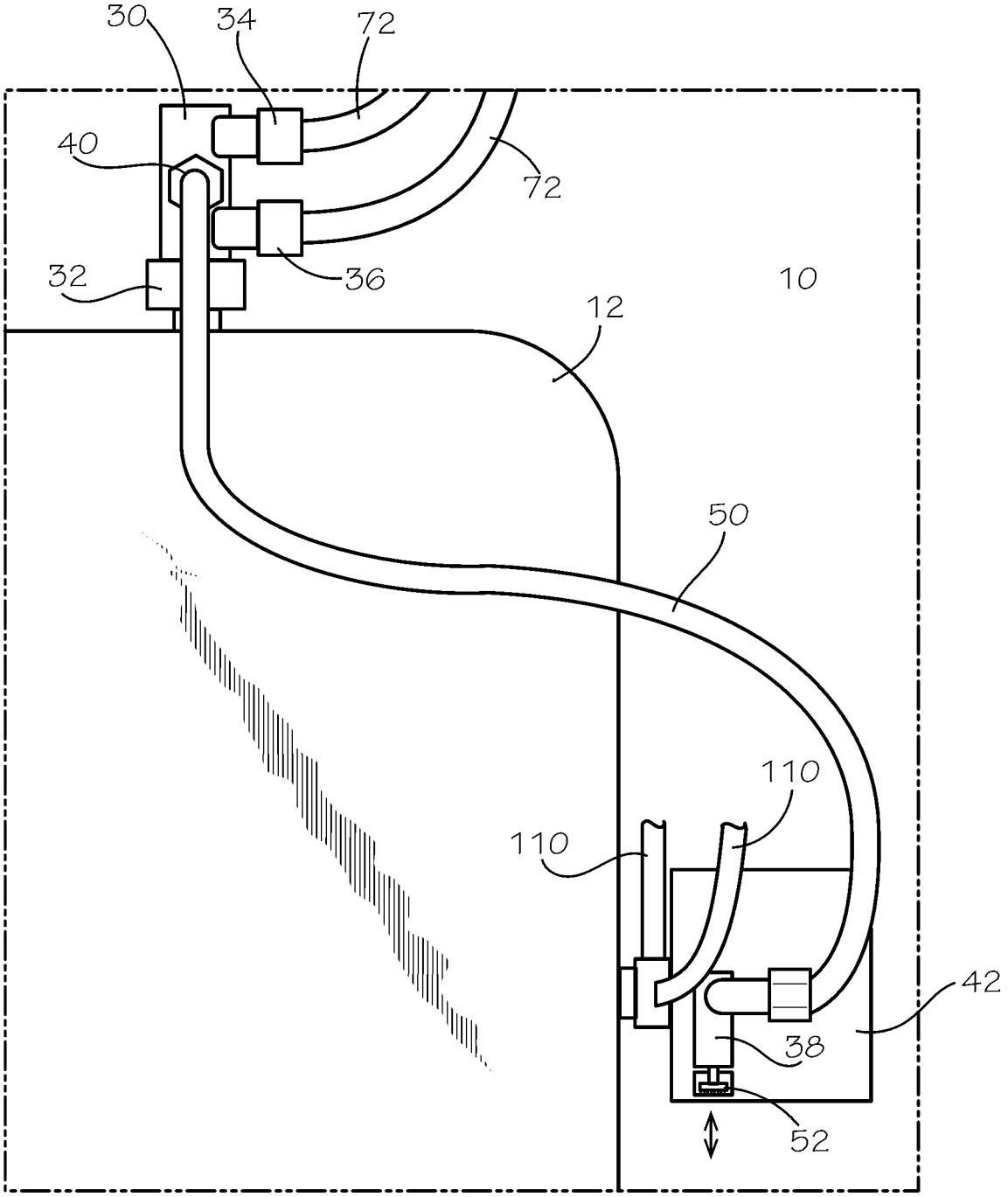
FIG. 6 is a partial detailed view of the air compressor apparatus of FIG. 1 showing the pneumatic coupling of an unloader port on a check valve of the air compressor apparatus to an exhaust unloader valve on a control unit of the apparatus.

As shown in FIGS. 2-3 and 6, the apparatus 10 can further include at least one exhaust unloader valve 38 which can be fluidly coupled to the first and/or second dual piston compressor assemblies 16 and 18. The exhaust unloader valve 38 can be selectively operable to release air pressure from within the first and second air compressor assemblies 16 and 18 when the motors 22 of the air compressor assemblies 16 and 18 are turned off between uses. In some embodiments, the check valve 30 can include an unloader port 40, and the exhaust unloader valve 38 can be fluidly coupled with the unloader port 40 on the check valve 30. When the exhaust unloader valve 38 is opened, air from the first and second dual piston compressor assemblies 16 and 18 can be bled through the exhaust unloader valve 38 until the pressure in the first and second dual piston compressor assemblies 16 and 18 returns to atmospheric pressure. When the motors 22 are started up again, the motors 22 will only have to work against atmospheric pressure as opposed to a higher pressure produced in the air compressor assemblies 16 and 18 during use. The exhaust unloader valve 38 can thus help reduce the required power and current draw needed by the motors 22 during startup as the force needed to turn the motors 22 from rest can be reduced.

Figure 10:
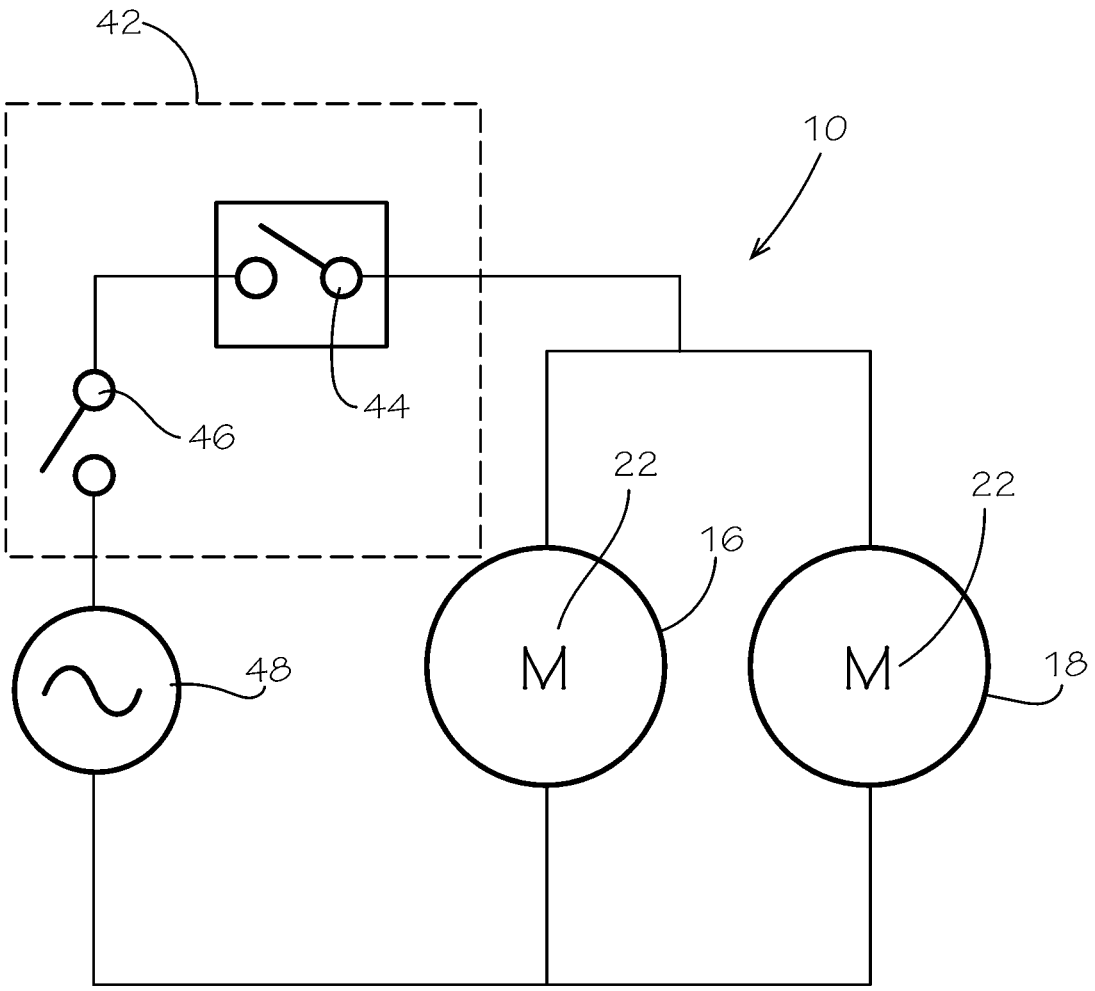
FIG. 10 is an exemplary schematic diagram of the power circuit of the air compressor apparatus of FIG. 1.

As shown in FIGS. 1, 6, and 10, a control unit 42 can be electrically coupled to the first and second dual piston compressor assemblies 16 and 18, the control unit 42 including a switch 44 moveable from an open position to a closed position to simultaneously provide power to the first and second dual piston compressor assemblies 16 and 18. In some embodiments, the switch 44 can be a manual switch operated by the user. In other embodiments, the switch 44 can be a pressure switch which can be fluidly coupled to air tank 12 and electrically coupled to the control unit 42. The pressure switch 44 can be configured to complete the electrical circuit in the control unit 42 and supply power to the motors 22 of the dual piston compressor assemblies 16 and 18 at defined intervals based on the air pressure in the air tank 12. For instance, the control unit 42 can be configured to complete the electrical circuit in the control unit 42 and supply power to the motors 22 in the compressor assemblies 16 and 18 when the pressure in the air tank 12 falls below a predetermined lower threshold. Power can be supplied to the motors 22 and air can be pumped into the air tank 12 until the pressure in the air tank 12 reaches a predetermined upper threshold, at which time the pressure switch 44 can open and the motors 22 can be stopped. The pressure switch 44 can reset and remain in the open position until the pressure in the air tank 12 falls below the predetermined lower threshold again.

In some embodiments, the control unit 42 can include two switches, a main switch 46 which can be manually closed by an operator to generally turn the apparatus 10 on and complete an electrical connection between an external power source 48 and the control unit 42, and a second pressure switch 44 which can be operable based on the air tank pressure to cause the control unit 42 to selectively provide power from the power source 48 to the motors 22 of the air compressor assemblies 16 and 18. The pressure switch 44 in some embodiments can be automated once the main switch 44 is actuated manually by a user, such that a user can start the air compressor apparatus 10 with a single turn of a single switch 46. However, the control unit 42 can start the motors in the first and second compressor assemblies 16 and 18 in response to a closing of the pressure switch 44 simultaneously.

In some embodiments, the control unit 42 can be configured to control actuation of the exhaust unloader valve 38 to selectively release air from the first and second dual piston compressor assemblies 16 and 18 through the exhaust unloader valve 38. For instance, the exhaust unloader valve 38 can be placed in an open orientation to bleed air from the dual piston compressor assemblies 16 and 18 when one or more of the switches 44 or 46 on the control unit 42 are in the open position such that power is not being supplied to the motors on the dual piston compressor assemblies 16 and 18. As such, air within the compressor assemblies 16 and 18 can be returned to atmospheric pressure anytime power is not being supplied to the compressor assemblies 16 and 18 in preparation for the next start up cycle for the compressor assemblies 16 and 18.

In some embodiments, the exhaust unloader valve 38 can be physically connected to the control unit 42 and the apparatus 10 can further include an unloader pneumatic line 50 fluidly coupled between the unloader port 40 on the check valve 30 and the exhaust unloader valve 38. When one or more of the switches 44 or 46 of the control unit 42 are in an open state, a mechanical arm 52 coupled to the switches 44 or 46 can be actuated to depress the exhaust unloader valve 38. In other embodiments, the exhaust unloader valve 38 can be a solenoid valve coupled directly to the check valve 30. The solenoid on the exhaust unloader valve 38 can be controlled electrically from the control unit 42, the control unit 42 configured to actuate the exhaust unloader valve 42 to bleed air from the compressor assemblies 16 and 18 when one or more of the switches 44 and 46 are open and power is not being supplied to the compressor assemblies 16 and 18.

In some embodiments, as shown in FIGS. 2-5, the first dual piston compressor assembly 16 can include a first head unloader valve 62 and the second dual piston compressor assembly 18 can include a second head unloader valve 64. The first and second head unloader valves 62 and 64 can be biased in an open position. The first head unloader valve 62 can be configured to move to a closed position after a predetermined pressure is built up in the first dual piston compressor assembly 16, and the second head unloader valve 64 can be configured to move to a closed position after a predetermined pressure is built up in the second dual piston compressor assembly 18. The head unloader valves 62 and 64 can generally include a housing 66 with an upper opening 68. Each head unloader valve 62 and 64 can include a plunger or stopper 70 movable between an open position shown in FIG. 4 and a closed position shown in FIG. 5 within the head unloader valves 62 and 64. Air can be allowed to pass through the upper opening 68 when the plunger or stopper 70 is in the open position. The plunger or stopper 70 can occlude the upper opening 68 when the plunger or stopper 70 is in the closed position, such that air is prevented from passing through the upper opening 68. The plunger or stopper 70 can be biased in the open position by a biasing member such as a spring 72.

The plunger or stopper 70 in the head unloader valves 62 and 64 can be configured to move to a closed position within the head unloader valves 62 and 64 once a predetermined pressure is reached within the first and second head unloader valves 62 and 64 which can overcome the biasing force applied by spring 72. In some embodiments, the head unloader valves 62 and 64 can be configured to close when the pressure inside the head unloader valves reaches a threshold pressure of 5 psi. In other embodiments, the head unloader valves 62 and 64 can be configured to close at threshold pressures of between about 5 and 15 psi.

While the head unloader valves 62 and 64 are in an open position, a portion 74 of the air being pumped by compressor assemblies 16 and/or 18 respectively can be dissipated to the atmosphere through the upper openings 68 in the head unloader valves 62 and 64 until the threshold pressure is reached. As such, during startup, as the motors in the compressor assemblies 16 and 18 start to pump air and pressurize the first and second compressor assemblies 16 and 18, the pressure inside the compressor assemblies 16 and 18, and thus the force acting against the motors during startup, can increase more gradually than if the compressor assemblies 16 and 18 were in a completely closed system. This gradual increase of the pressure inside the compressor assemblies 16 and 18 can help minimize the power draw and peak current required by the air compressor assemblies 16 and 18 during startup.

In some embodiments, each of the dual piston compressor assemblies 16 and 18 can include first and second head outlets 54 and 56. A pneumatic line 72 can be fluidly coupled to the first head outlet 54 and the air tank 12, and an auxiliary pneumatic line 74 can be fluidly coupled to the second head outlet 56 and the main pneumatic line 72. In some embodiments, the main pneumatic lines 72 and the auxiliary pneumatic lines 74 can each be fluidly coupled with the air tank 12 or a check valve 30 connected to the air tank 12. The first head outlets 54 can generally receive air pumped from one of the pistons in the corresponding dual piston compressor assembly, and the second head outlet 56 can generally receive air pumped from the other piston. As such, air pumped by each dual piston compressor assembly 16 and 18 can exit the pump heads of the compressor assemblies 16 and 18 through a dedicated head outlet via separate pneumatic lines 72 and 74. This can provide an advantage over some prior art dual piston compressor assemblies where air is pumped from both pistons through a single head outlet, as back pressure can build up around the piston farthest from the outlet, which can increase the force applied against the motor and the power and current draw required by the motor. Having two head outlets 54 and 56 associated with corresponding pistons in each compressor assembly 16 and 18 can allow air from each piston to be directed through a dedicated head outlet 54 or 56 and help reduce back pressure around either piston.

In some embodiments, the first head unloader valve 62 can be fluidly coupled between the second head outlet 56 and the auxiliary pneumatic line 74 of the first dual piston compressor assembly 16, and the second head unloader valve 64 can be fluidly coupled between the second head outlet 56 and the auxiliary pneumatic line 74 of the second dual piston compressor assembly 18. As such, during startup, air pumped from the piston closest to the first head outlet 54 on each compressor assembly can pump air into the main pneumatic line 72 to pressurize the compressor assemblies 16 and 18 while air pumped from the other piston closest to the second head outlet 56 and the respective head unloader valve 62 or 64 can be partially dissipated by the respective head unloader valve 62 or 64 until the threshold pressure is reached and the head unloader valves 62 and 64 close. This arrangement can again help reduce back pressure on the piston furthest away from the main pneumatic line 72 during startup while the motors are ramping up to a steady state.

In some embodiments, as shown in FIGS. 2 and 7, each compressor assembly 16 and 18 can include a first piston head 76 positioned over one of the reciprocating compressor pistons, the first head outlet 54 defined on the first piston head 76, a first head inlet 80 defined on the first piston head 76. A second piston head 78 can be positioned over the other reciprocating compressor piston, the second head outlet 56 defined on the second piston head 78, a second head inlet 82 defined on the second piston head 78. The head inlets 80 and 82 can provide intake air into the corresponding piston cylinders 85 during a down stroke of the piston, and the intake air can be pumped out of the piston cylinders 85 and through the corresponding head outlet 54 and 56 on the upstrokes of the pistons. In some embodiments, fluid passages 86 can extend between corresponding inlet portions and corresponding outlet portions of the piston heads 76 and 78 to help balance intake air being pulled in to the compressor assemblies 16 and 18 via head inlets 80 and 82 and help balance intake air pumped out of the compressor assemblies 16 and 18 via head outlets 54 and 56.

In some embodiments, each of the first and second compressor assemblies includes a first air filter 90 fluidly coupled with the first head inlet 80 on the first piston head 76 and a second air filter 92 fluidly coupled to the second head inlet 82 of the second piston head 78. The air filters 90 and 92 can help clean and remove dust and other impurities from intake air being pulled into the piston cylinders 85, which can help increase the efficiency and reduce wear on the air compressor assemblies 16 and 18.

Referring now to FIGS. 1,6, 9, and 10, in some embodiments, when the air compressor apparatus is connected to a single 120 volt power source via electrical plug 114 and the switch 44 and/or 46 on the control unit 42 is moved to the closed position, the first and second dual piston compressor assemblies 16 and 18 can be powered simultaneously and combined can draw a current of less than 20 amps from the 120 volt power source during start up. In some embodiments, during startup, each motor 22 can draw a peak current of 8 amps from the power source during startup, for a total current draw of 16 amps by the motors 22 during startup. The apparatus 10 of the present disclosure thus provides a significant advantage over prior art dual motor compressors because a total current draw of less than 20 amps during startup when connected to a single 120V power source can help allow the air compressor apparatus 10 of the present disclosure to be powered by a single 120 volt power source safely and without tripping the breaker for the power source 48. Multiple breaker circuits or a 240V power source are not required to run the air compressor apparatus 10 of the present disclosure, though the apparatus 10 of the present disclosure can be utilized on multiple power circuits or 240V to achieve an even further reduction on current draw by the apparatus 10.

In some embodiments the air compressor apparatus 10 can include a user interface 100 which can allow a user to control various parameters of the operation of the air compressor unit. For instance in some embodiments, the user interface 100 can include an air tank pressure gauge 102 so that the user can monitor the pressure in the air tank 12 during use. The user interface 100 can also include a pressure regulator 104 for controlling the pressure of air delivered to the pneumatic tooling from the air compressor apparatus 10. An administered air pressure gauge 106 can also be included on the user interface 100 so the user can visually monitor the regulated air pressure being delivered to pneumatic tooling during use of the air compressor apparatus 10. One or more quick connect fittings 108 can also be included on the user interface 100 to connect one or more pneumatic tools to the air compressor apparatus 10. Tooling pneumatic lines 110 can be fluidly connected between the air tank 12 and the quick connect fittings 108, air tank pressure gauge 102, and the administered air pressure gauge 106 to supply air from the air tank 12 to the pneumatic tooling.

In some embodiments, the air compressor assemblies 16 and 18 can be positioned in a compressor housing 112 which can be connected to the air tank 12. In some embodiments, the compressor housing 112 can be a positioned on top of the air tank 12. The compressor assemblies 16 and 18 can be positioned within the compressor housing 112 to help provide an improved aesthetic appearance for the air compressor assembly 10 as the compressor assemblies 16 and 18 can be at least partially hidden from view, as well as other pneumatic lines and electrical wiring associated with the air compressor apparatus 10. In some embodiments, the compressor housing 112 can be vented to allow for air flow through the compressor housing 112 to help cool and prevent overheating of the compressor assemblies 16 and 18. The user interface 100 and the various components thereof can be mounted on the compressor housing 112 in some embodiments.

The compressor assemblies 16 and 18 have been referred to herein as dual piston compressor assemblies. However, in some embodiments, single piston compressor assemblies can be utilized depending on the needs of the user, and the various other pneumatic line orientations and unloading features taught herein can be utilized to help control and minimize power consumption and current draw during startup of the air compressor apparatus 10.

Thus, although there have been described particular embodiments of the present invention of a new and useful DUAL MOTOR COMPRESSOR, it is not intended that such references be construed as limitations upon the scope of this invention.

What is claimed is:

1. An air compressor apparatus comprising:

an air tank;

a first dual piston compressor assembly fluidly coupled with the air tank, the first dual piston compressor assembly including a first head unloader valve;

a second dual piston compressor assembly fluidly coupled with the air tank, the second dual piston compressor assembly including a second head unloader valve;

a control unit electrically coupled to the first and second dual piston compressor assemblies, the control unit including a switch moveable from an open position to a closed position to simultaneously provide power to the first and second dual piston compressor assemblies; and at least one exhaust unloader valve operable by the control unit to selectively release air from the first and second dual piston compressor assemblies when the switch moves from the closed position to the open position;

wherein each dual piston compressor assembly includes a first and second head outlet, a pneumatic line fluidly coupled to the first head outlet and the air tank, and an auxiliary pneumatic line fluidly coupled to the second head outlet and the air tank, and wherein, the air tank includes a tank inlet, the apparatus further comprises a dual head check valve having a first inlet, a second inlet, a check valve outlet, and an unloader port;

the check valve outlet is fluidly coupled to the tank inlet;

the first dual piston compressor assembly is fluidly coupled to the first inlet;

the second dual piston compressor assembly is fluidly coupled to the second inlet; and the exhaust unloader valve is fluidly coupled to the unloader port.

2. The apparatus of claim 1, wherein the exhaust unloader valve is coupled to the control unit and the apparatus further comprises an unloader pneumatic line fluidly coupled between the unloader port and the exhaust unloader valve.

3. The apparatus of claim 1, wherein when the air compressor apparatus is connected to a single 120 volt power source and the switch is moved to the closed position, the first and second dual piston compressor assemblies combined draw a current of less than 20 amps from the 120 volt power source.

4. The apparatus of claim 1, wherein each of the first and second dual piston compressor assemblies includes a motor driving two reciprocating compressor pistons, the control unit electrically connected to the motor on each of the first and second dual piston compressor assemblies.

5. The apparatus of claim 4, wherein each of the motors has an operating speed of less than about 2000 rotations per minute.

6. The apparatus of claim 4, wherein each of the first and second dual piston compressor assemblies includes:

a first piston head positioned over one of the reciprocating compressor pistons, the first head outlet defined on the first piston head, the first piston head including a first head inlet; and a second piston head positioned over the other reciprocating compressor piston, the second head outlet defined on the second piston head, the second piston head including a second head inlet.

7. The apparatus of claim 6, wherein each of the first and second dual piston compressor assemblies includes a first air filter fluidly coupled with the first head inlet on the first piston head and a second air filter fluidly coupled to the second head inlet of the second piston head.

8. The apparatus of claim 1, wherein:

the first head unloader valve is fluidly coupled between the second head outlet and the auxiliary pneumatic line of the first dual piston compressor assembly; and the second head unloader valve is fluidly coupled between the second head outlet and the auxiliary pneumatic line of the second dual piston compressor assembly.

9. The apparatus of claim 1, wherein:

the first and second head unloader valves are biased in an open position;

the first head unloader valve is configured to move to a closed position after a predetermined pressure is built up in the first dual piston compressor assembly; and the second head unloader valve is configured to move to a closed position after a predetermined pressure is built up in the second dual piston compressor assembly.

10. The apparatus of claim 1, wherein the first and second dual piston compressor assemblies are configured to collectively supply air to the air tank at a rate of at least 10 cubic feet per minute at a pressure of 40 PSI.

11. The apparatus of claim 1, wherein the auxiliary pneumatic line is fluidly coupled between the second head outlet and the pneumatic line, the auxiliary pneumatic line fluidly coupled to the air tank via the pneumatic line.

12. An air compressor apparatus comprising:

an air tank having a tank inlet;

a dual head check valve having a first inlet, a second inlet, a check valve outlet, and an unloader port, the check valve outlet fluidly coupled to the tank inlet;

a first dual piston compressor assembly fluidly coupled to the first inlet of the dual head check valve, the first dual piston compressor assembly including a first head unloader valve;

a second dual piston compressor assembly fluidly coupled to the second inlet of the dual head check valve, the second dual piston compressor assembly including a second head unloader valve;

an exhaust unloader valve fluidly coupled to the unloader port of the check valve; and a control unit electrically coupled to the first and second dual piston compressor assemblies to control operation of the first and second dual piston compressor assemblies, the control unit configured to control actuation of the unloader valve to selectively release air from the first and second dual piston compressor assemblies through the exhaust unloader valve.

13. The apparatus of claim 12, wherein the control unit includes a single switch movable between an open position and a closed position, wherein when the single switch is in the closed position the control unit is configured to provide power simultaneously to both the first and second dual piston compressor assemblies.

14. The apparatus of claim 13, wherein when the single switch moves to the closed position and the control unit provides power to the first and second dual piston compressor assemblies, the first and second dual piston compressor assemblies combined are configured to draw less than 20 amps of current from a single 120 volt power supply during start up.

15. The apparatus of claim 13, wherein the control unit is configured to actuate the unloader valve to release air within the first and second dual piston compressor assemblies when the switch moves from the closed position to the open position.

16. The apparatus of claim 12, wherein each dual piston compressor assembly includes a first and second head outlet, a pneumatic line fluidly coupled to the first head outlet and the air tank, and an auxiliary pneumatic line fluidly coupled to the second head outlet and the pneumatic line.

17. An air compressor apparatus electrically connectable to a single 120 volt power source, the air compressor comprising:

an air tank having a tank inlet;

a dual head check valve having a first inlet, a second inlet, a check valve outlet, and an unloader port, the check valve outlet fluidly coupled to the tank inlet;

a first dual piston compressor assembly fluidly coupled to the first inlet of the dual head check valve, the first dual piston compressor assembly including a first head unloader valve configured to move to a first head unloader valve closed position when a predetermined pressure is built up in the first dual piston compressor assembly;

a second dual piston compressor assembly fluidly coupled to the second inlet of the dual head check valve, the second dual piston compressor assembly including a second head unloader valve configured to move from an open position to a second head unloader valve closed position when the predetermined pressure is built up in the second dual piston compressor assembly;

an exhaust unloader valve fluidly coupled to the unloader port of the check valve; and a control unit electrically coupled to the first and second dual piston compressor assemblies, the control unit including a switch moveable from an open position to a closed position to simultaneously provide power to the first and second dual piston compressor assemblies, the switch operable to control release of air from the first and second dual piston compressor assemblies through the exhaust unloader valve when the switch moves to the open position;

wherein each dual piston compressor assembly includes a first and second head outlet, a pneumatic line fluidly coupled to the first head outlet and the air tank, and an auxiliary pneumatic line fluidly coupled to the second head outlet and the pneumatic line; and wherein when the apparatus is electrically connected to the single 120 volt power source and the switch is moved to the closed position, the first and second dual piston compressor assemblies combined draw a current of less than 20 amps from the 120 volt power source during startup.

18. The apparatus of claim 17, wherein each dual piston compressor assembly includes two head inlets, each head inlet providing air to be compressed by a corresponding piston of the dual piston compressor assembly.

19. An air compressor apparatus comprising:

an air tank;

a first dual piston compressor assembly fluidly coupled with the air tank, the first dual piston compressor assembly including a first head unloader valve;

a second dual piston compressor assembly fluidly coupled with the air tank, the second dual piston compressor assembly including a second head unloader valve;

a control unit electrically coupled to the first and second dual piston compressor assemblies, the control unit including a switch moveable from an open position to a closed position to simultaneously provide power to the first and second dual piston compressor assemblies;

wherein each dual piston compressor assembly includes a first and second head outlet, a pneumatic line fluidly coupled to the first head outlet and the air tank, and an auxiliary pneumatic line fluidly coupled to the second head outlet and the air tank, and wherein:

the first and second head unloader valves are biased in an open position;

the first head unloader valve is configured to move to a closed position after a predetermined pressure is built up in the first dual piston compressor assembly; and the second head unloader valve is configured to move to a closed position after a predetermined pressure is built up in the second dual piston compressor assembly.

20. The apparatus of claim 19, further comprising at least one exhaust unloader valve operable by the control unit to selectively release air from the first and second dual piston compressor assemblies when the switch moves from the closed position to the open position.

21. The apparatus of claim 20, wherein, the air tank includes a tank inlet, the apparatus further comprises a dual head check valve having a first inlet, a second inlet, a check valve outlet, and an unloader port;

the check valve outlet is fluidly coupled to the tank inlet;

the first dual piston compressor assembly is fluidly coupled to the first inlet;

the second dual piston compressor assembly is fluidly coupled to the second inlet; and the exhaust unloader valve is fluidly coupled to the unloader port.

22. The apparatus of claim 19, wherein when the air compressor apparatus is connected to a single 120 volt power source and the switch is moved to the closed position, the first and second dual piston compressor assemblies combined draw a current of less than 20 amps from the 120 volt power source.

23. The apparatus of claim 19, wherein each of the first and second dual piston compressor assemblies includes a motor driving two reciprocating compressor pistons, the control unit electrically connected to the motor on each of the first and second dual piston compressor assemblies.

24. The apparatus of claim 23, wherein each of the motors has an operating speed of less than about 2000 rotations per minute.

25. The apparatus of claim 23, wherein each of the first and second dual piston compressor assemblies includes:

a first piston head positioned over one of the reciprocating compressor pistons, the first head outlet defined on the first piston head, the first piston head including a first head inlet; and a second piston head positioned over the other reciprocating compressor piston, the second head outlet defined on the second piston head, the second piston head including a second head inlet.

26. The apparatus of claim 25, wherein each of the first and second dual piston compressor assemblies includes a first air filter fluidly coupled with the first head inlet on the first piston head and a second air filter fluidly coupled to the second head inlet of the second piston head.

27. The apparatus of claim 19, wherein:

the first head unloader valve is fluidly coupled between the second head outlet and the auxiliary pneumatic line of the first dual piston compressor assembly; and the second head unloader valve is fluidly coupled between the second head outlet and the auxiliary pneumatic line of the second dual piston compressor assembly.

28. The apparatus of claim 19, wherein the first and second dual piston compressor assemblies are configured to collectively supply air to the air tank at a rate of at least 10 cubic feet per minute at a pressure of 40 PSI.

29. The apparatus of claim 19, wherein the auxiliary pneumatic line is fluidly coupled between the second head outlet and the pneumatic line, the auxiliary pneumatic line fluidly coupled to the air tank via the pneumatic line.

* * * * *